US005238503A

United States Patent [19]

Phenix et al.

[11] Patent Number: 5,238,503

[45] Date of Patent: Aug. 24, 1993

[54] DEVICE FOR DECONTAMINATING A SEMICONDUCTOR WAFER CONTAINER

[75] Inventors: Robert B. Phenix, Milton; Winfield T. Tandy, Essex Junction, both of Vt.

[73] Assignee: International Business Machines Corporation, Armonk, N.Y.

[21] Appl. No.: 682,795

[22] Filed: Apr. 9, 1991

[51] Int. Cl.[5] ..... A47L 15/00

[52] U.S. Cl. ..... 134/37; 15/304; 15/310; 15/316.1; 134/167 R

[58] Field of Search ..... 15/304, 310, 312.1, 15/316.1; 134/167 R, 168 R, 171

[56] References Cited

U.S. PATENT DOCUMENTS

| | | | |
|---|---|---|---|
| 1,730,658 | 10/1929 | Jensen | 134/168 R |
| 3,606,897 | 9/1971 | Tobin, III | 134/86 |
| 3,737,941 | 6/1973 | Miller | 15/100 |
| 4,017,330 | 4/1977 | Aidlin | 15/304 |
| 4,183,115 | 1/1980 | Zakarian | 15/316.1 |
| 4,208,761 | 6/1980 | Ionescu | 15/304 |
| 4,380,842 | 4/1983 | Thomas | 15/312.1 |
| 4,437,479 | 3/1984 | Bardina | 15/309.2 |
| 4,461,054 | 7/1984 | Oehlenschlager et al. | 15/312.1 |
| 4,603,661 | 8/1986 | Nelson | 15/316.1 |
| 4,660,248 | 4/1987 | Young | 15/340.1 |
| 4,676,006 | 6/1987 | Tolson | 15/316.1 |
| 4,677,704 | 7/1987 | Huggins | 15/316.1 |
| 4,750,505 | 6/1988 | Inuta | 15/310 |
| 4,770,680 | 9/1988 | Machida et al. | 55/385.1 |
| 4,808,234 | 2/1989 | McKay | 134/167 R |
| 4,904,153 | 2/1990 | Iwasawa | 15/301 |

FOREIGN PATENT DOCUMENTS

| | | | |
|---|---|---|---|
| 0048280 | 4/1977 | Japan | 15/304 |
| 5248280 | 4/1977 | Japan | 15/310 |

OTHER PUBLICATIONS

IBM Technical Disclosure Bulletin, vol. 23, No. 7A, Dec. 1980 pp. 2752-2753.

*Primary Examiner*—Harvey C. Hornsby
*Assistant Examiner*—Randall E. Chin
*Attorney, Agent, or Firm*—Calfee, Halter & Griswold

[57] ABSTRACT

A decontamination device for a wafer container having a chamber for storing semiconductor wafers and inner surfaces surrounding such chamber is provided. The device includes a support/containment assembly for providing a substantially sealed containment compartment and a gas flow assembly, mounted on the support/containment means, for supplying and filtering a substantially continuous flow of circulation gas throughout the containment compartment. Additionally, the gas flow assembly periodically directs a flow of blow-off gas towards the inner surfaces of the wafer container whereby particles adhered to such surfaces will be released and entrained by the continuous flow of circulation gas. Manipulating assemblies, also mounted on the support/containment means manipulate the wafer container whereby such chamber is in communication with the containment compartment. The assemblies also position the gas flow assembly within the chamber of the container and in close proximity to its inner surfaces.

14 Claims, 5 Drawing Sheets

DEVICE FOR DECONTAMINATING A SEMICONDUCTOR WAFER CONTAINER

FIELD OF THE INVENTION

This invention relates generally as indicated to a device and method for decontaminating a wafer container which is used in a semiconductor device fabrication system. More particularly, the present invention elates to a device/method for removing airborne contamination particles in the container by providing a continuously filtered circulation gas flow. Additionally, the device/method releases charted or otherwise adhered contamination particles form the inner surfaces of the container whereby they may be entrained by the continuously filtered circulation gas and subsequently removed.

BACKGROUND OF THE INVENTION

Semiconductor device are commonly manufactured in a semiconductor fabrication process nd the earlier stages of this process involve semiconductor "wafers." In a typical fabrication process, a plurality of these wafers are loaded in a carrier, or container, for transportation to and form the appropriate wafer-processing stations. In some fabrication systems, the container designed to directly hold the wafers by providing, for instance, the container with wafer-receiving ridges or grooves. In other systems, the container is designed to hold a "cassette" in which the wafers have previously been stacked. However, while a carrier may be of many designs, almost all carriers may be viewed as having chamber for storing the wafers and as having inner surfaces surrounding this chamber.

At some wafer-processing stations, the wafers are almost immediately unloaded, subjected to the appropriate fabrication procedure, and then re-loaded into the carrier for conveyance to a subsequent station. In other cases, the wafer-loaded carrier is stored temporarily in, for example, a closed clean box at the relevant wafer-processing site in anticipation of the next semiconductor fabrication step. In still other wafer-processing stations, such as water rinsing and wet chemical etching, the wafers are processed without being unloaded from the carrier.

A key enemy in almost any semiconductor fabrication process is "particulate contamination" which is the impurity caused by particles and chemicals contained in the fabricating environment. Such contamination is known to be directly responsible for decreased reliability in the fabricated semiconductor devices. While particulate contamination has always been a potential problem, its harmful impact proceeds to increase as the circuit pattern sizes of semiconductor devices continue to decrease to sub-micron dimensions.

Accordingly, particulate contamination control is essential to the success of a semiconductor device fabrication process. As such, diligent attempts are made to insure minimal particulate contamination in the surrounding "fabrication environment." An important part of this fabrication environment is the wafer carrier, or container, because the semiconductor wafers are actually exposed to the air within the chamber and they are in such close proximity to the inner surface. Because of the essentially continual use of such carriers in the fabrication process, airborne particulate tend to accumulate within the carrier chamber. Additionally, certain fabrication treatments tend to encourage contamination particulate to statically or otherwise adhere to the inner surfaces of the carrier surrounding the chamber. This contamination of the carrier chamber and inner surfaces seems to inevitably occur even in fabrication environments where particulate contamination is kept to an absolute minimum.

As such it would be desirable to periodically withdraw a carrier from the fabrication process and thoroughly decontaminate its chamber and inner surface. Such a decontamination operation would preferably include the removal of airborne contamination particles in the carrier chamber. Additionally, to be fully effective, the decontamination operation would also need to include the steps of releasing, and subsequently removing, contamination particles statically or otherwise adhered to the inner surfaces of the carrier surrounding the chamber.

SUMMARY OF THE INVENTION

The present invention provides a decontamination device for a wafer container having a chamber for storing semiconductor wafers and inner surfaces surrounding such chamber. The device includes a support/containment assembly for providing a substantially sealed containment compartment and a gas flow assembly, for supplying and filtering a substantially continuous flow of circulation gas throughout the containment compartment. Additionally, the gas flow assembly periodically directs a flow of blow-off gas towards the inner surfaces of the wafer container whereby particles adhered to such surfaces will be released and entrained by the continuous flow of circulation gas. The decontamination device may include ionization components, mounted on the gas flow assembly, for periodically ionizing the gas flow through the containment compartment whereby charged containment particles adhered to the inner surfaces of the wafer container will be released and entrained by the circulation gas. Manipulating assemblies, also mounted on the support/containment assembly, manipulate the wafer container whereby the chamber is in communication with the containment compartment. These manipulating assemblies also position the gas flow assembly within the chamber and in close proximity to the inner surfaces whereby the blow-off gas will be properly directed.

The present invention also provides a method of decontaminating a wafer container having a chamber for storing semiconductor wafers and inner surfaces surrounding this chamber. The method includes providing a substantially sealed containment compartment and continuously supplying and filtering a flow of circulation gas throughout the containment compartment. The wafer container is then manipulated so that its chamber is in communication with the sealed containment chamber. A flow of blow-off gas is periodically directed towards the inner surfaces of the wafer container. The method may also include the step of periodically ionizing the circulation gas and blow-off gas whereby statically charged containment particles will be released and entrained by the circulation gas.

These and other features of the invention are fully described and particularly pointed out in the claims. The following descriptive annexed drawings set forth in detail one illustrative embodiment, however this embodiment is indicative of but one of the various ways in which the principles of the invention may be employed.

DETAILED DESCRIPTION

Figure 1:
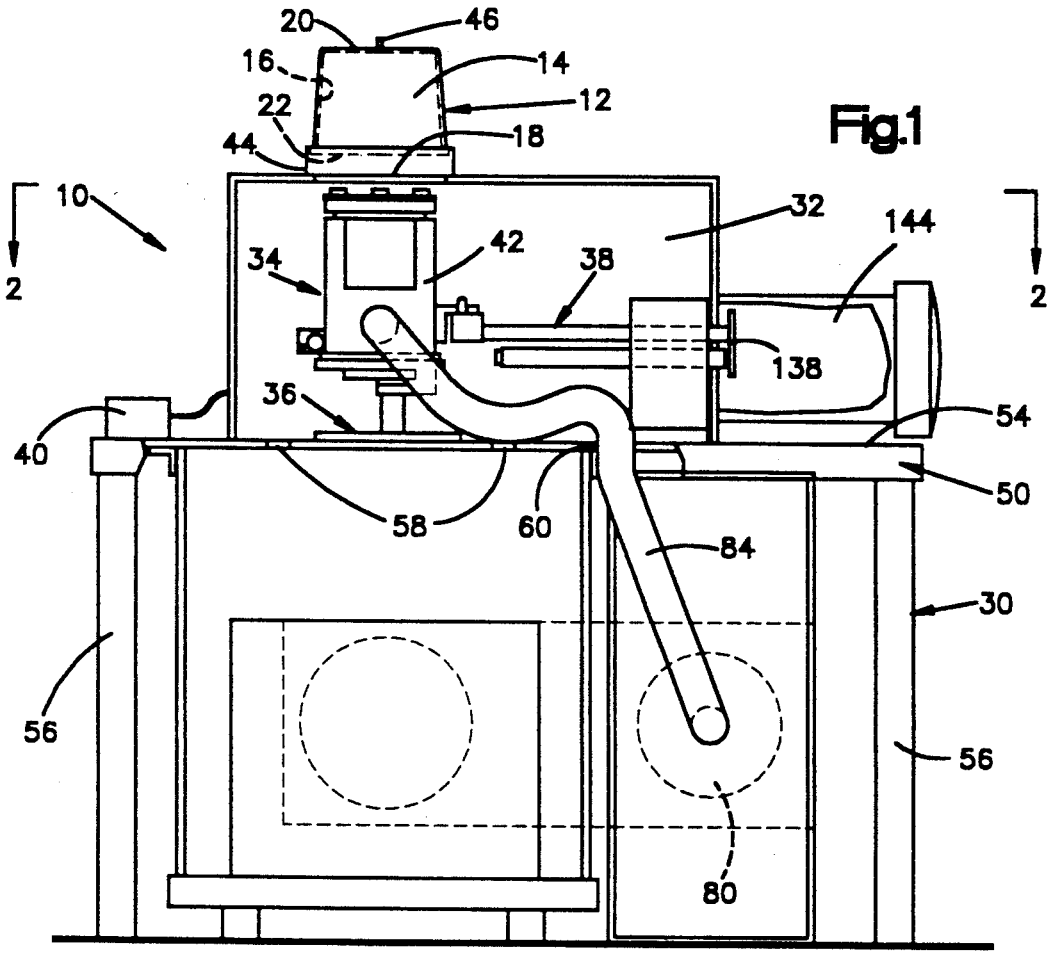
FIG. 1 is a front view of a decontamination device according to the present invention.

Turning now to the drawings in detail and initially to FIG. 1, a decontamination device 10 for a wafer container 12 is shown. In a typical fabrication process, a plurality of wafers (not shown) would be loaded into this container 12 for transportation to and from the appropriate wafer-processing stations. The container 12, like most carriers of this type, may be viewed as having an inner chamber 14 for storing the wafers and inner surfaces 16 and 18 surrounding the chamber 14. Additionally, the container 12 includes a top portion 20 and a bottom portion 22 detachably connected to the top portion, although these features may be particular to the illustrated design of the carrier.

The decontamination device 10 of the present invention is designed to provide periodic decontamination for carriers such as the wafer container 12. Thus, while the device 10 would not be directly involved in a semiconductor fabrication process, it would play an important role in the success of such a process by insuring minimal particulate contamination in the wafer container 12. More specifically, the decontamination device 10 removes airborne contamination particles in the container chamber 14 and releases, and subsequently removes, contamination particles statically or otherwise adhered to the inner surfaces 16 and 18 of the container 12.

The decontamination device 10 includes a support-/containment assembly 30 which supports the other components of the device while at the same time provides a substantially sealed containment compartment 32. The support elements of the assembly 30 may be designed in any manner which is compatible with the other components of the device 10 and which accommodates the container 12. More particularly, the support/contamination assembly 30 is adapted so that the container 12 may be sealably mounted thereto, and during the intermediate stages of the decontamination process, the container chamber 14 will be in communication with, or form an extension of, the containment compartment 32.

The actual "decontamination" process, which takes place within the containment compartment 32, is performed by a gas flow assembly 34. As is explained in more detail below, the gas flow assembly 34 continuously circulates, and filters, a low velocity circulation gas within the containment compartment 32 and the container chamber 14. In this manner, any airborne contamination particles in the circulation gas are removed whereby the gas within the containment compartment 32 is constantly purified.

In addition to this circulation gas flow, the gas flow assembly 34 periodically directs a flow of high velocity compressed "blow-off" gas towards the inner surfaces 16 and 18 of the container 12 thereby encouraging the release any adhered particles therefrom. Still further, the gas flow assembly 34, at appropriate points in the decontamination cycle, ionizes either the circulation gas and/or the blow-off gas thereby persuading the release of any statically charged particles clinging to the inner surfaces 16 and 18 of the container 12. The released particles are then entrained by the circulation gas and, because this circulation gas is constantly being filtered, the released contamination particles are eventually removed.

The decontamination device 10 further includes a first manipulating assembly 36 and a second manipulating assembly 38 which manipulate the container 12 and the gas flow assembly 34 so that the decontamination process may be effectively performed. Although manual control of some or all of the various components of the decontamination device 10 is possible, automatic operation is preferred. To this end, the gas flow assembly 34 and the manipulating assemblies 36 and 38 are electrically powered, the power being supplied to the device 10 when a switch (not shown) is manually placed in an "on" position. Additionally, the device includes a programmable controller 40 which automatically coordinates the operation of the gas flow assembly 34 and the manipulating assemblies 36 and 38.

Perhaps the best way to explain the interaction of the components of the decontamination device 10, and their coordination via the programmable controller 40, is to briefly outline a typical decontamination cycle. Before beginning of a decontamination cycle, the power switch is then turned on, thereby supplying electric power to the various components of the decontamination device 10. Once the power is turned on, the gas flow assembly 34 continuously circulates, and filters, a circulation gas within the containment compartment 32. Additionally, the programmable controller 40 is energized whereby it may automatically control the operation of the device.

To begin a cycle of the decontamination process, a container, such as the container 12, is mounted in the appropriate position on top of the support/containment assembly 30. A start button (not shown) is then depressed to further activate the decontamination device 10 to perform the next stages of the decontamination process. The depression of this button results in the first manipulating assembly 36 uncoupling, and separating, the top portion 20 and the bottom portion 22 of the wafer container 12. The support/containment assembly 30 is designed so that such uncoupling and separating results in the container chamber 14 being in communication with, or forming an extension of, the containment compartment 32. The circulation gas will then flow into the chamber 14 thereby entraining any airborne contaminant particles in this space. These entrained particles will subsequently be removed during the continuous filtering of the circulation gas.

After the portions 20 and 22 of the container 12 have been separated, the first and second manipulating assemblies 36 and 38 manipulate the gas flow assembly 34 so that its dispensing component, namely a manifold 42, travels past the inner surfaces 16 and 18 of the container 12. As the manifold 42 travels past these surfaces, the "blow-off" gas is directed towards the inner surfaces 16 and 18 of the container 12 thereby encouraging the release of any adhered particles therefrom. Additionally, the ionization components of the gas flow assembly 34 will be energized thereby releasing contaminant particles statically adhered to the inner surfaces 16 and 18 of the container 12. The released particles are then entrained by the flow of circulation gas and, because this circulation gas is constantly being filtered, the released particles are eventually removed.

Thus the decontamination device 10 includes a support/containment assembly 30, a gas flow assembly 34, a first manipulating assembly 36, and a second manipulating assembly 38, all of which cooperate to decontaminate the wafer container 12. Each of these assemblies is explained in detail below, however, for the sake of clarity in explanation, a brief background of the wafer container 12 is initially provided.

A. The Wafer Container 12

While the wafer container 12 is not part of the decontamination device 10 itself, it is this item which the device is particularly adapted to accommodate. For this reason, it is perhaps important to note that in most cases, the decontamination device 10 will be designed to fit a particular carrier, rather than the carrier being conformed to fit a certain device. In any event, a brief background of the container 12 is helpful in understanding the structure and operation of the decontamination device 10.

In a typical fabrication process, a plurality of wafers (not shown) would be loaded in a carrier, such as the container 12, and transported to and from appropriate wafer-processing stations. Thus, as an initial matter, the general geometry of the container 12, or perhaps more accurately the container chamber 14, is arranged to accommodate the particular sizing of the wafers. In the illustrated embodiment, the container 12 is designed to accommodate a cassette (not shown). In a wafer-processing employing a carrier of this type, the wafers would be stacked in a cassette, and the cassette would then be loaded in the container 12.

Additionally, due to the low-particle contamination demands of most semiconductor fabrication processes, the wafer container 12 is an environmentally secure vessel capable of storing the wafers within a Class 10 or better micro-environment. For similar and other reasons, the container 12 is preferably made of a compact, sturdy, and impact resistant material. By way of example, the top portion 20 and the bottom portion 22 could both be injection molded from polycarbonate.

While the decontamination device 10 could, with appropriate alterations, accommodate a variety of carriers, the illustrated embodiment is designed for a carrier such as the wafer container 12. The container 12 is typical of a product of Asyst Technologies Inc. which is sold and marketed under the trademark SMIF-Pod TM. In this container 12, the top portion 20 is approximately cubical in shape forming a substantially cubical chamber 14. The bottom perimeter of the top portion 20 is surrounded by a border 44 which defines a rectangular bottom opening. The bottom portion 22 is substantially plate-shape and is dimensioned to fit tightly within the bottom opening defined by the border 44.

As indicated above, the top portion 20 is detachably coupled to the bottom portion 22 of the container 12. Although not shown in the drawings, this coupling is accomplished by four latches which are attached to the bottom surface of the top portion 20 and which are biased inwardly to a closed position. The bottom surface of the bottom portion 22 has four strategically placed 10 peripheral grooves which received the latches when biased to the closed position.

To open the container 12, or in other words, to remove the bottom portion 22 from the top portion 20, all four latches must be simultaneously forced outwardly to an open position. This four-latch feature prevents the container 12 from being opened unless it is properly mounted on an appropriate loading interface. As is explained in more detail below, the first manipulating assembly 36 includes such an interface, as it is this component which uncouples the portions 20 and 22 of the container 12 whereby the decontamination process may be effectively performed.

The container 12 may include other characteristics compatible with, or helpful in, the semiconductor fabricating process. For example, the container 12 could contain a handle 46 attached to the top side of the upper portion 20, for easy transportation from station to station by manual or automatic methods during the fabrication process. Additionally, the container 12 may include a locking mechanism (not shown) for discouraging vibration or movement of the wafers, and/or a disposable inner liner (not shown) for minimizing decontamination needs.

The above description is primarily directed towards the illustrated wafer container 12, however, the invention is capable of accommodating a variety of carrier styles. Thus while the decontamination device 10 is described below as being particularly designed for a certain wafer container 12, this is purely for explanatory purposes. One will appreciate that the invention may be adapted to accommodate a variety of carrier styles, in which the container has an inner chamber 14 for storing the wafers and inner surfaces surrounding 16 and 18 surrounding the chamber. Additionally, the decontamination device 10 could be modified so that a cassette could also be decontaminated at the same time as the container 12.

B. The Support/Containment Assembly 30

Turning now to the decontamination device 10, its main structural component is the support/containment assembly 30. This assembly 30 is designed to support the other assemblies of the device whereby the decontamination process may be effectively performed. The assembly 30 also provides the appropriate micro-environment for performing the decontamination process, namely the sealed containment compartment 32.

Figure 2:
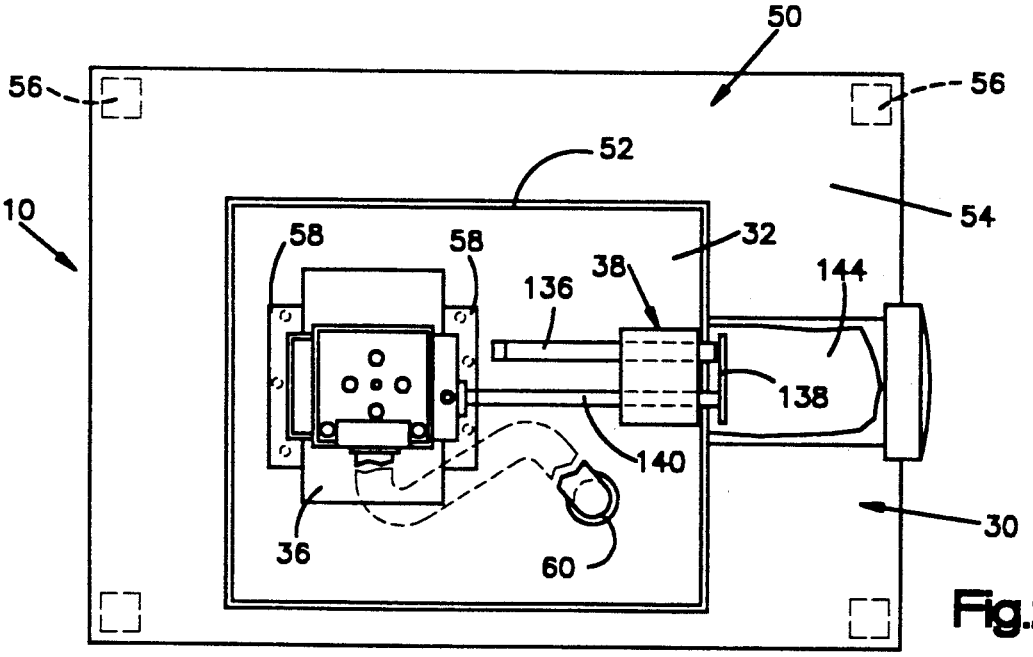
FIG. 2 is a top view of the decontamination device as seen from line 2—2 in FIG. 1.

As is best shown in FIGS. 1 and 2, the support/containment assembly 30 includes a table support, indicated generally at 50 on top of which a cage 52, preferably made of a transparent material, is mounted. In the preferred embodiment, the cage 52 forms the sealed containment compartment. However, other arrangements are possible and are contemplated within the scope of the present invention. For example, the decontamination device 10 could be placed in a "clean room" which itself provides the appropriate micro-environment. In such as set-up, the clean room and the supporting members of the device 10 would together form the support/containment assembly 30, and the container 12, when appropriately manipulated, would be in communication with the clean room forming the containment compartment 32.

The table support 50 includes a rectangular horizontal panel, or table top, 54 which is held at an elevated position by four table legs 56. In the illustrated embodiment, the table legs 56 are sized so that the containment compartment 32 is accessibly positioned at just above waist level.

The table top 54 is sized to comfortably hold the cage 52, and to extend below portions of the second manipulating assembly 38 which stretch beyond the containment compartment 32. Additionally, the table top 54 has strategically placed openings for accommodating the gas flow assembly 34. More specifically, the table top 54 has two rectangular "cut-out" openings 58 within the containment compartment 32 which, as will be explained in more detail below, serve as exhaust ducts for the gas flow assembly 34. The table top 54 also includes a third circular annular opening 60 which, in the illustrated device 10, is located to the right of the openings 58. As a further note, both the height of the table legs 56 and the size of the table top 54 allow certain components of the gas flow assembly 34 to be conveniently stored beneath the table top 54.

Although the above-described form of the support-/containment assembly 30 is preferred due to its compact and convenient arrangement, other styles are of course possible and may be desirable in certain applications. To accomplish the goals of the invention, the assembly 30 must merely be designed to adequately support and accommodate the other assemblies of the device 10 whereby the decontamination process may be effectively performed and the assembly must provide the appropriate micro-environment for performing the decontamination process.

C. The Gas Flow Assembly 34

While the support/containment assembly 30 allows the decontamination process to be effectively performed by, among other things, providing the appropriate micro-environment, the actual "decontamination" is performed by the gas flow assembly 34. To this end, the gas flow assembly 34 supplies a continuous flow of filtered, low velocity circulation gas. Additionally, the assembly 34 periodically provides a high velocity flow of blow-off clean compressed gas. Still further, at the appropriate points in the decontamination process, the assembly 34 supplies an ionized gas flow by ionizing either the circulation gas or the blow-off gas.

Because the circulation gas is constantly filtered, any airborne contaminants in the container chamber 14 and the rest of the containment compartment 32 are thereby removed. The blow-off gas and the ionization process encourage the release of any contamination particles statically or otherwise adhered to the inner surfaces 16 and 18 of the container 12. These released particles are then entrained by the flow of circulation gas, and eventually removed from this flow when it is filtered.

Perhaps at this point it should be noted that although the general term "gas" is used throughout this discussion, in the preferred embodiment this gas will constitute air. However, other gasses may be desirable, or necessary, in certain applications. The gas flow assembly 34 should be easily compatible with a gas other than air, either with no, or minor alterations.

In any event, the "dispensing" component of the gas flow assembly 34 is a manifold 42 which dispenses both the circulation gas and the blow-off gas and which further serves as a support for the "ionizing" components of the assembly 34. At certain points in the decontamination process, the manifold 42, or at least its upper portion, will be inserted into the container chamber 14. As such, the manifold 42 is preferably shaped to accommodate this insertion. In the illustrated embodiment, the chamber 14 is cubical and thus the main body 68 of the manifold 42 is correspondingly cubical in shape. The manifold 42 also includes a bottom extension 70 which projects laterally outwardly from, and in the illustrated embodiments to the left of, the main body 68 of the manifold 42. The bottom extension 70 accommodates certain elements of the gas flow assembly 34 as is explained in more detail below.

Addressing initially the circulation gas, it circulates through the containment compartment 32 and also through the container chamber 14 which, at certain stages of the decontamination process, forms an extension of the compartment 32. The flow of circulation gas is preferably in the magnitude of 100 $ft^3$/minute, and preferably maintains the containment compartment 32 at a slight positive pressure of 0.40 to 1.0 inches of water, gage. This slight positive pressure helps to insure that surrounding air possibly containing particulate contaminants does not creep into the containment compartment 32.

Figure 4:
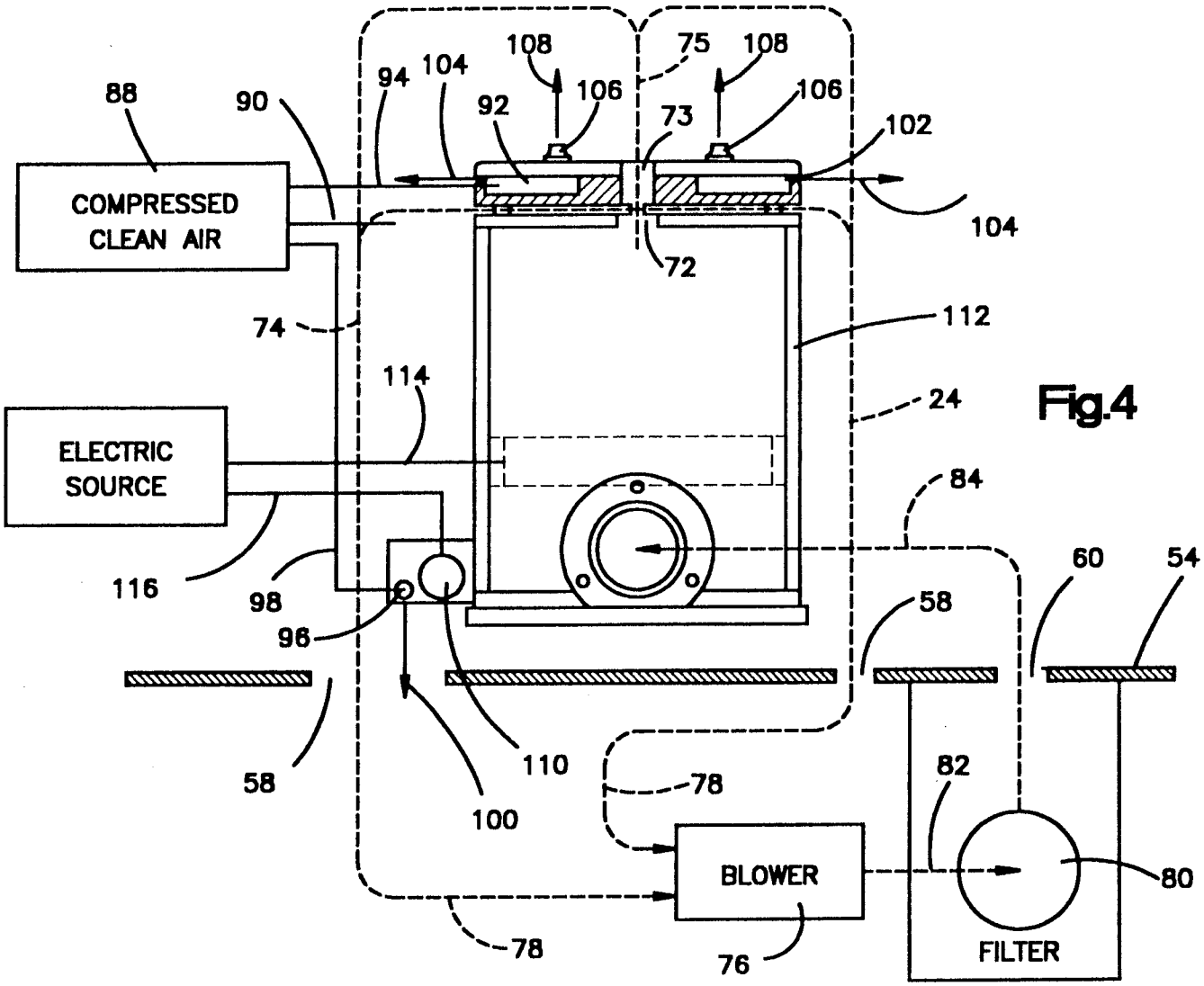
FIG. 4 is a schematic diagram of the flow patterns through the gas flow assembly of the decontamination device.

In examining the flow paths of the circulation gas, it is helpful to refer additionally to FIG. 4 in which the relevant patterns are schematically shown. While the circulation gas essentially travels in a closed cycle, it may be viewed as initially being dispensed through appropriate openings 72 and 73 in the manifold 42 (lines 74 and 75 in FIG. 4) into the containment compartment 32. While circulating through the compartment 32 and container chamber 14, any airborne contaminant particles in the chamber will become entrained in the circulation gas.

The circulation gas with the contaminant particles entrained therein, is directed through the containment compartment 32 by an induced draft created by a blower 76. More specifically, the dispensed low velocity gas is drawn through the exhaust ports 58 in the table top 54 and into the inlet (not specifically shown) of the blower 76 (line 78) which is located below the table top 54. The circulation gas then travels from the outlet of the blower 76 (not specifically shown) through a high efficiency particulate air (HEPA) filter 80 (line 82) whereby the entrained contaminants will be removed from or "filtered out of" the circulation gas. The filter 80 is sealably connected to the outlet of the blower 76.

The filter 80 is preferably located below the table top 54, adjacent to the blower 76. While any suitable filter 80 may be used, it should be of a sufficient collection efficiency to adequately remove particulate in the intended application. For example, a 0.1 μm HEPA filter which is a product of NITTA Co. has a collection efficiency for the particles of the 0.1 μm size which is above 99.999%.

After passing through the filter 80, the circulation gas travels through a conduit 84 (line 86) which is attached to an inlet of the manifold 42. In the illustrated embodiment, the conduit 84 travels from below the table top 54, through the accommodating opening 60 and is attached to a lower portion of the manifold 42. As is explained in more detail below, the manifold 42 is manipulated relative to the table top 54 and the containment compartment 32 during certain stages of the decontamination process and thus it is important that the conduit 84 be made of a contractible/extendable material, or of a sufficient length, to accommodate such manipulation.

After traveling through the conduit 84 to the manifold inlet, the circulation gas is once again dispensed through the outlet openings 72 in the manifold (line 74). Thus the circulation gas theoretically travels in a closed loop cycle. However, to compensate for any actual losses, make-up flow is provided from a compressed high velocity gas supply 88 (line 90) when necessary to maintain the desired positive pressure within the containment compartment 32.

Turning now to the blow-off gas, it is again helpful to refer additionally to FIG. 4 in which the relevant flow patterns are schematically shown. The blow-off gas, like the circulation gas, is dispensed through the manifold 42, however only at certain stages of the decontamination process. The precise timing of these stages is explained more fully below, however, it should suffice at this point to say that they are related to the positioning of the manifold 42 relative to the inner surfaces 16 and 18 of the container 12.

As is shown schematically in FIG. 4, the blow-off gas is initially supplied from the compressed gas supply 88 which, as explained above, also provides make-up flow to the circulation gas. Although the supply 88 is shown schematically to the left of the manifold 42 in FIG. 4, this is simply for illustrative reasons. In actual practice, the compressed high velocity gas supply 88 could be stored at any convenient location, such as underneath the table top 54.

However, regardless of the exact location of the blow-off gas supply 88, the supplied blow-off gas would travel either to an upper manifold inlet 92 located on the main body 68 of the manifold 42 (line 94) or to a lower air tube 96 (line 98) which is housed in the bottom extension 70 of the manifold 42. While the lines 94 and 98 are only shown schematically in FIG. 4, they would be comprised of flexible tubing which would normally be of a much smaller diameter than the conduit 84. However, like the conduit 84, the actual lines supplying the blow-off gas to the manifold 42 would have to be able to accommodate the manipulation of the manifold 42. To this end, these lines could be made of a contractible/expandable material, or as preferred, of a sufficient length for the desired extension.

In any event, the blow-off gas may be dispensed from the manifold 42 in one of three ways. First, the compressed gas supplied to the air tube 96 may be directed downwardly through nozzles (not shown) in the lower portion of the air tube 96 (line 100). In the operation of the decontamination device, this downward blast of the blow-off gas would be provided when the manifold 42 is traveling over the inner surface 18 of the bottom portion 22 of the container 12. In this manner, the gas flow assembly 34 encourages the release of adhered contaminant particles, so that they may be entrained in the circulation gas. These entrained particles will then be removed from the circulation gas by the filter 80.

Second, the blow-off gas supplied to the upper manifold inlet 92 may be outwardly dispensed through an air knife 102 (line 104). Alternatively the blow-off gas supplied to the inlet 92 may be upwardly dispensed through blow-off nozzles 106 located on the top of the manifold 42 (line 108). This outward and upward dispersement preferably occurs when the upper portion of the manifold 42 is traveling in close proximity to the inner surface 16 of the upper portion 14 of the container 12. As one may appreciate, the outward dispersement will be directed towards the side, vertically oriented, regions of the inner surface 16, while the upward dispersement will be directed towards the top, horizontally oriented region of the inner surface 16. This directed blow-off flow is designed to dislodge any contamination particles attached to these side and top regions of the inner surface 16, whereby the dislodged particles will become entrained in the circulation gas and subsequently removed by the filter 80.

After the blow-off gas is dispensed from the manifold 42, it essentially mixes with the circulation gas in the containment compartment 32. As such, the dispensed blow-off gas will also be drawn through the exhaust ports 58 in the table top 54, through the blower 76 and filter 80 and returned to the manifold 42 as circulation gas. As indicated above, it is preferable to maintain the contaminant compartment 32 at a slight positive pressure of 0.40 to 1.0 inches of water, gage. Thus, although not expressly shown on the drawings, a bleed-off assembly may be necessary to prevent the use of blow-off gas from increasing the pressure in the containment compartment beyond a desirable level.

A further function of the gas flow assembly 34 is to, at appropriate points in the decontamination cycle, ionize either the low velocity or high velocity gas flow to encourage the release of any statically charged particles clinging to the inner surfaces 16 and 18 of the container 12. In the preferred embodiment, this ionization is provided by ionization elements mounted on the manifold 42, and more particularly, a tubular static bar 110 and a circular static bar 112. The tubular static bar 110 is housed in the bottom extension 70 of the manifold main body 68 and is located adjacent to the lower air tube 96. The circular static bar 112 located concentrically within the main body 68 of the manifold 42.

In order to be energized at the appropriate time, the static bars 110 and 112 are electrically connected to the electrical power source. As such electrical umbilical cords, such as lines 114 and 116 shown schematically in FIG. 4, extend into the containment compartment 32 for this connection. While the lines 114 and 116 are only shown schematically in FIG. 4, they would also have to be of a sufficient length to accommodate the manipulation of the manifold 42.

Thus the gas flow assembly 34 plays a key role in the decontamination process by supplying a continuous flow of filtered circulation gas and periodically directing ionized blow-off gas towards the inner surfaces 16 and 18 of the container 12. In the preferred embodiment, a dispensing component, such as the manifold 42 dispenses both the circulation gas and the blow-off gas, and this dispersement occurs within the transparent cage 52. However, other arrangements are possible and are contemplated by the present invention. For example, the decontamination device 10 may be placed in a clean room whereby the walls of the room, rather than the cage 52, define the separate containment compartment 32. In such a set-up, the circulation gas would probably be provided by the circulating/filtering mechanism for the room itself and the gas flow assembly 34 would include this circulating/filtering mechanism.

D. The Manipulation Assemblies 36 and 38

The decontamination device 10 further includes a first manipulating assembly 36 and a second manipulating assembly 38 which manipulate the container 12 and the gas flow assembly 34 so that the decontamination process may be effectively performed. The operation and interaction of these assemblies is best explained by referring additionally to FIGS. 6A–6G which show these components in various stages of the decontamination process.

Addressing initially the first manipulating assembly 36, it actually serves several purposes in the decontamination process. One such purpose is an "uncoupling" step in which the assembly 36 uncouples the bottom portion 22 from the top portion 20 of the wafer container 12. In a subsequent "separating" step, the first manipulation assembly 36 vertically moves the bottom portion 22 downwardly away from the top portion 20 thereby separating the portions 20 and 22 from each other and positioning the bottom portion 22 within the containment compartment 32. In this manner, the container chamber 14 is in communication with, or in other words forms an extension of, the containment compartment 32. The first manipulating assembly 36 also serves, at a later stage in the process, as an elevator for vertically positioning the manifold 42 within the top portion 20, or the chamber 14, of the wafer container 12.

These functions of the first manipulating assembly 36 are similar to those performed by an assembly adapted to load and unload wafers from a carrier. As such, in the illustrated embodiment, an assembly of this type has been incorporated into the decontamination device 10. More specifically, the illustrated assembly 36 is typical of a product sold by Asyst Technologies Inc. under the trademark SMIF-Arm TM 2000. This assembly 36 is shown isolated from the other components of the decontamination device 10 in FIG. 5.

Figure 5:
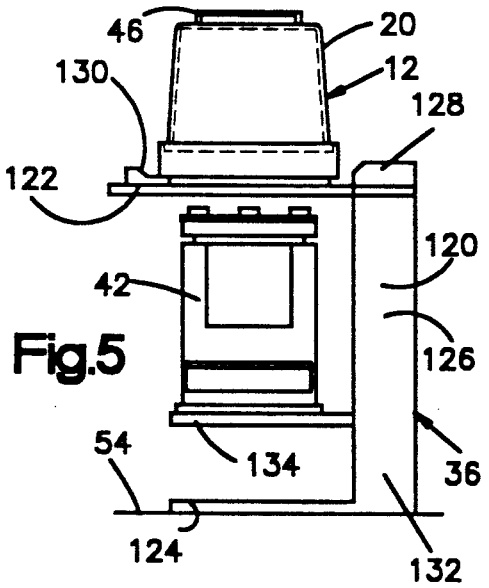
FIG. 5 is a side view of a first manipulating assembly of the device of FIGS. 1 and 2, this assembly being shown isolated from the rest of the device.

As shown in FIG. 5, the first manipulating assembly 36 includes a frame 120 which is basically C-shape in cross-section. The frame 120 includes a top horizontal member 122 a bottom horizontal member 124, and a connecting vertical member 126. In reference to the support/containment assembly 30, the bottom horizontal member 124 is mounted on the table top 54, and is enclosed totally within the containment compartment 32. The connecting vertical member 126 is also enclosed within the compartment 32, except for an upper portion 128 adjacent the top horizontal member 122. This upper portion 128 and the top horizontal member 122 actually form a portion of the top side of the containment compartment 32. In other words, extend above the containment compartment 32. The top side of the containment compartment 32 is formed by the upper portion 128 of the vertical member 126, the top horizontal member 122 of the frame 120, and the cage 52 which is attached in a gas-tight manner to of these members.

The top horizontal member 122 includes a container-mounting mechanism 130 which receives the wafer container 12, or more particularly the bottom border 44 of the top portion 20. This container-mounting mechanism 130 is adapted so that when the bottom portion 22 of the container 12 is removed, the chamber 14 is in gas-tight communication with, or forms an extension of, the containment compartment 32. The actual uncoupling of the bottom portion 22 from the top portion 20 is performed by an interface which is not specifically shown in the drawings. This interface simultaneously drives the four latches from their biased, closed position to an outward open position whereby the bottom portion 22 will be released.

The first manipulating assembly 36 further includes an elevator 132 having a horizontal platform 134 which extends in a cantilever manner from a level adjusting mechanism. While not specifically shown in the drawings, the level adjusting mechanism includes conventional parts enabling it to vertically shift the horizontal platform 134 in the desired manner. More specifically, the level adjusting mechanism is capable of vertically moving the horizontal platform 134 between a bottom manifold-loading level (FIG. 6B), a manifold-unloading level (FIG. 6F), an upper blow-off level (FIG. 6E), and a container-manipulating level (FIG. 6A). The level adjusting mechanism is preferably designed so that the horizontal platform 134 may travel smoothly through these levels during some stages of the decontamination cycle, and so that it may stop precisely at these levels at other points in the cycle.

Figure 6B:
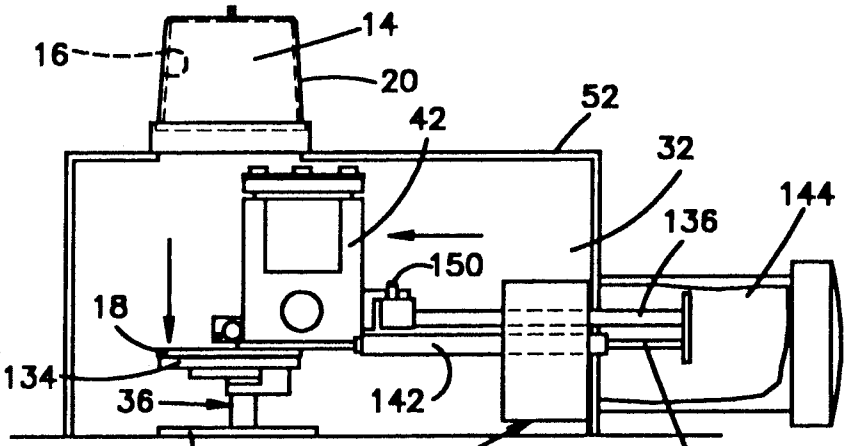
FIG. 6A–6G are side views of the gas flow assembly, the first manipulating assembly and the second manipulating assembly, these components being shown isolated from the rest of the device and in various stages of the decontamination process.
Figure 6A:
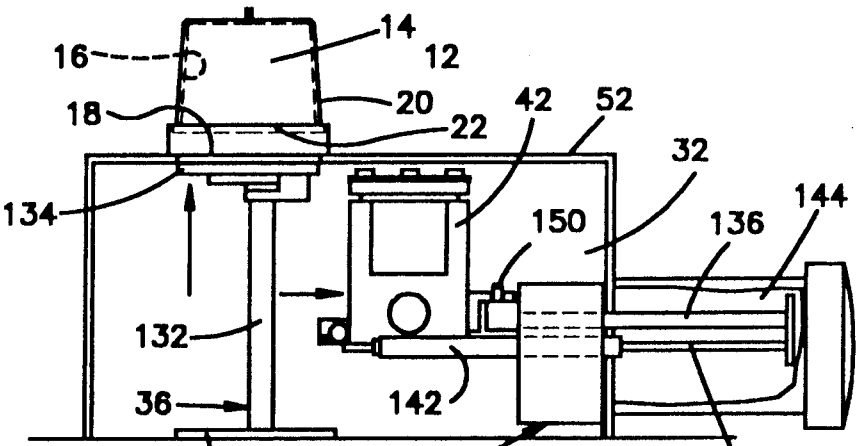
Figure 6D:
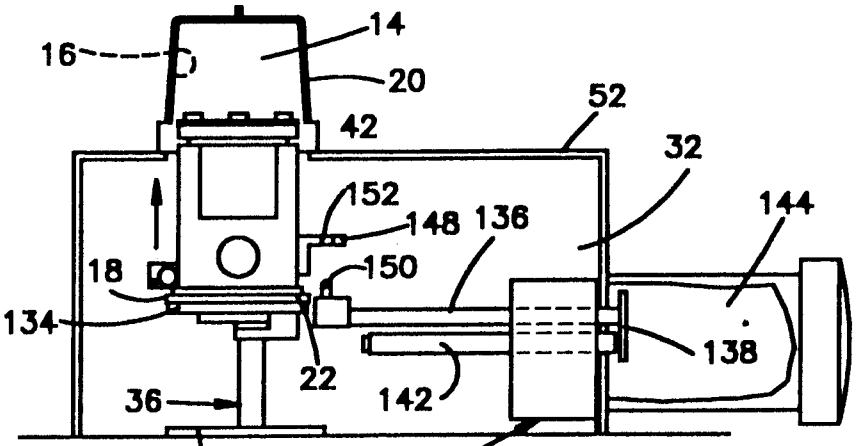
Figure 6C:
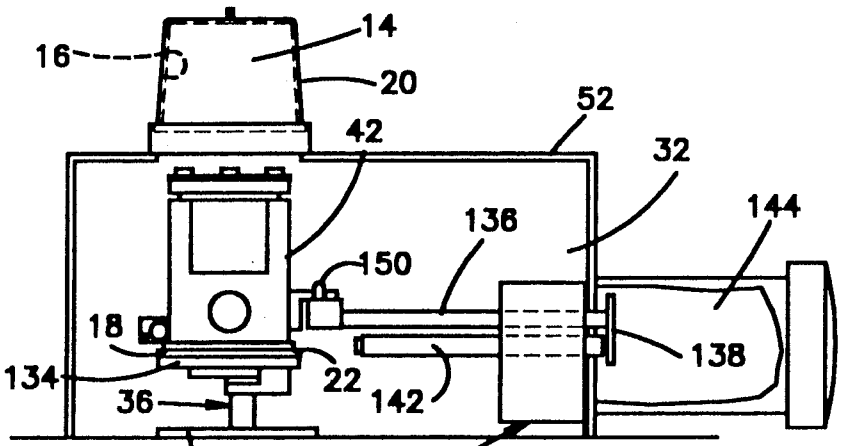
Figure 6F:
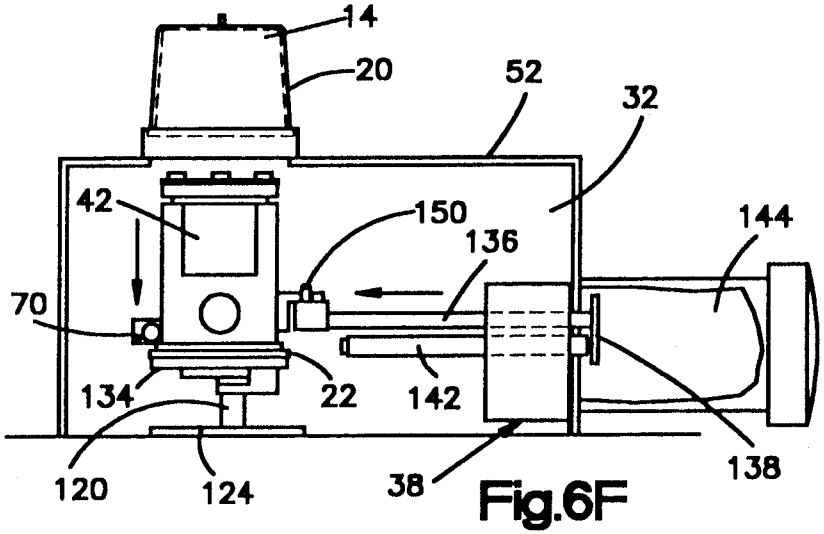
Figure 6E:
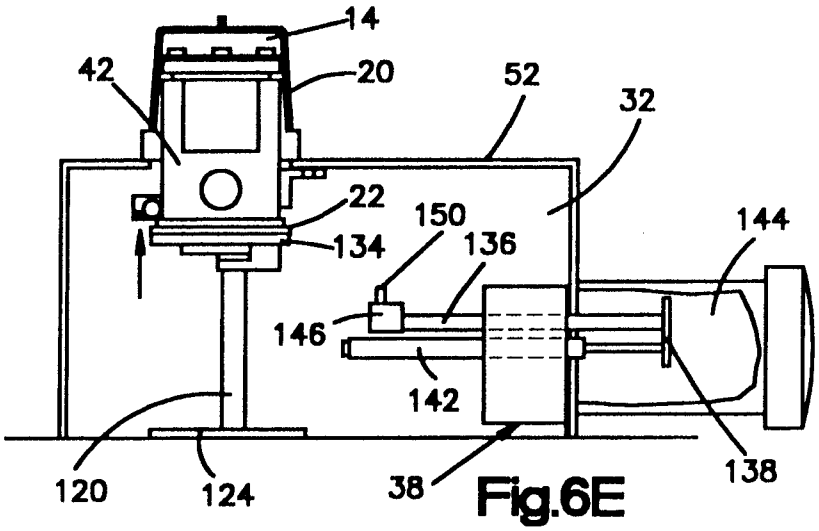
Figure 6G:
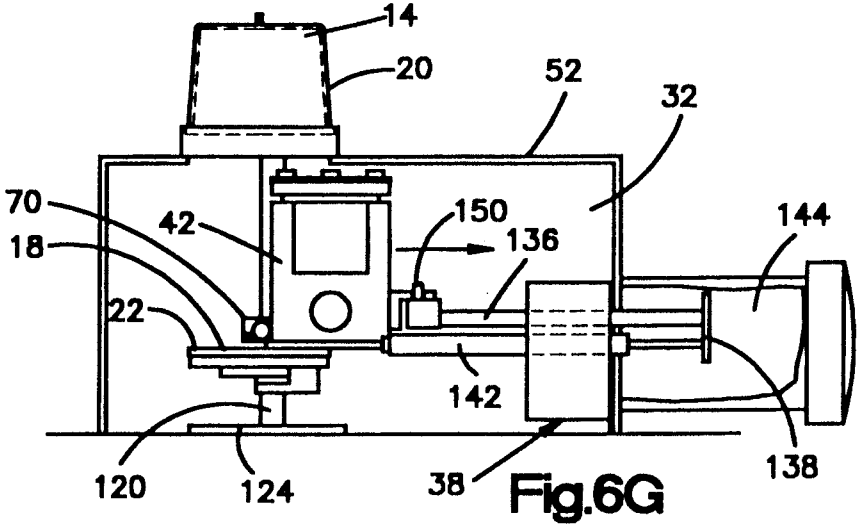

In general reference to the decontamination process, the bottom manifold-loading level shown in FIG. 6B is the lower most level, and the manifold-unloading level shown in FIG. 6F is slightly above the loading-level. These levels are important in the transfer of the manifold 42 between the first manipulating assembly 36 and the second manipulating assembly 38 as is explained in more 10 detail below. The upper blow-off level shown in FIG. 6E is located between the manifold-unloading level and the container-manipulating level. At certain stages of the cycle, this level will be the level at which the manifold 42 is fully inserted within the top portion 20 of the container 12.

The container-manipulating level shown in FIG. 6A is the uppermost level and is located near or at the top of the containment compartment 32. It is at this level at which the first manipulating assembly 36 uncouples the top portion 20 and the bottom portion 22 of the container 12. After this uncoupling, the bottom portion 22 of the container will be received by the horizontal platform 134. To enhance this receiving function, the upper surface of the horizontal platform 134 and the lower surface of the bottom portion 22 may include mating components to ensure the correct and secure positioning of the bottom portion 22 on the horizontal platform 134.

Turning now to the second manipulating assembly 38, it serves to horizontally move the manifold 42 from a rest position shown in FIG. 6A to a transfer position shown in FIG. 6C. To accomplish this movement, the assembly 38 includes a load arm 136 to which the manifold 42 is removably mounted. This load arm 136 is attached, as by a connector 138, to the piston 140 of an air cylinder 142 whereby extension of the piston 140 causes lateral movement of the load arm 136. The load arm 136 and the air cylinder 142 are dimensioned so that the range of this lateral movement corresponds to the span between the rest position and the transfer position of the manifold 42. When in the rest position, the load arm 136 and piston 140 will extend beyond the containment compartment 32, and thus projection pocket 144 is provided to accommodate this extension.

Figure 3:
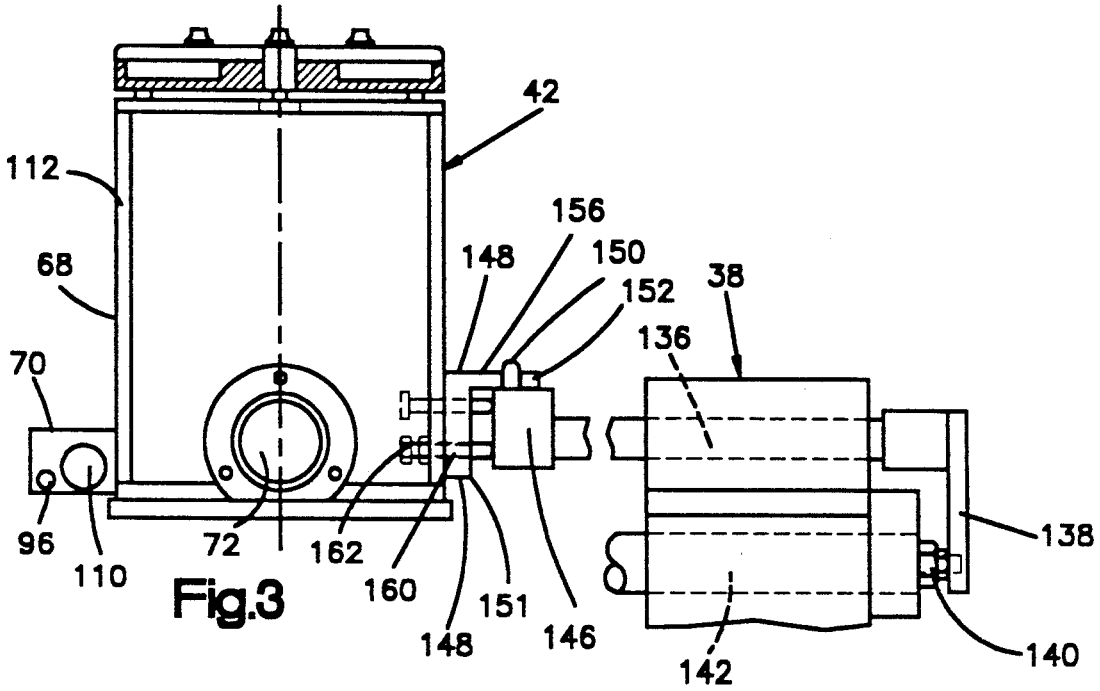
FIG. 3 is a side view of a gas flow assembly which is removably mounted to a second manipulating assembly, these components being shown isolated from the rest of the device.

The removable mounting of the manifold 42 to the load arm 136 is best explained by referring additionally to FIG. 3. As shown, a mounting block 146 is attached to the distal end of the load arm 136. This mounting block 146 is adapted to be removably mated with a mounting bracket 148 attached to the manifold 42. More specifically, the mounting block 146 includes upward projection pins 150 which are dimensioned to be received securely, yet removably, within aligning openings 152 in the mounting bracket 148.

Regarding the attachment of the mounting bracket 148 to the manifold 42, it is permanently attached to the opposite side, and at about the same level, as the bottom extension 70 of the manifold 42. The mounting bracket 148 is basically L-shape in cross section and includes a first vertical leg 154 and a second horizontal leg 156. The second horizontal leg 156 extends from the upper end of the vertical leg 154 and contains the aligning openings 152. The vertical leg 154 is the member actually attached to the manifold main body 68, and this attachment is accomplished by a fastener 158. Other locator pins 160 are positioned below the fastener 158 and project beyond the vertical leg 154. These locator pins 160 serve to limit the lateral movement of the load arm 136 and each include an adjustment mechanism 162 inside the manifold 42.

Thus the first manipulating assembly 36 and the second manipulating assembly 38 manipulate the container 12 and the gas flow assembly 34 so that the decontamination process may be effectively performed.

E. The Operation of the Decontamination Device 10

Although a typical cycle of the decontamination process was briefly outlined above, a description of the exact interaction of the various components of the decontamination device is now possible. Before or after the container 12 is appropriately placed on the container mounting mechanism of the first manipulating assembly 36, the power switch is turned on to begin a cycle of the decontamination process. In this manner, electric power is supplied to the various components of the decontamination device 10 whereby the gas flow assembly 34 begins to continuously circulate, and filter, the circulation gas within the containment compartment 32. Additionally, the programmable controller 40 is energized whereby it may automatically control the operation of the decontamination device 10.

To begin a decontamination cycle, the start button is manually depressed. The manipulating assembly 36 then proceeds to uncouple, via the interface, the top portion 20 and the bottom portion 22 of the wafer container 12. At this point in the cycle, the horizontal platform 134 is elevated to the container-manipulating level. Thus, once the bottom portion 22 is uncoupled, it is received by the horizontal platform 134 for further manipulation (FIG. 6A). This further manipulation entails the elevator 132 vertically moving the horizontal platform 134, and the bottom portion 22 of the container 12 placed thereon, to the manifold-loading level (FIG. 6B). The top and bottom portions 20 and 22 of the container 12 are thereby separated from each other and the container chamber 14 is now in communication with, or forms an extension of, the containment compartment 32.

Up until this point in the cycle, the manifold 42 of the gas flow assembly 34 has been located in the rest position shown in FIG. 6A. In this rest position, the second manipulating assembly, or more particularly the load arm 136 and the piston 140 connected thereto, are in a fully retracted condition whereby they extend into the projection pocket 144. Additionally, the manifold 42 is removably mounted to the second manipulating assembly 38. More particularly, the projection pins 150 in the mounting block 146 are inserted into the aligning openings 152 in the mounting bracket 148 attached to the manifold 42.

Once the first manipulating assembly 36 moves the bottom portion 22 of the container 12 to the lower manifold-loading level, the piston 140 of the air cylinder 142 is extended whereby the load arm 136 and attached manifold 42 are moved inwardly. (See FIG. 6B). During this inward movement, blow-off gas is supplied to the lower air tube 96 and lower static bar 110 is energized. In this manner, as the manifold 42 travels over the bottom portion 22 of the container 12 (now placed on the horizontal platform 134), the ionized blow-off gas will be directed towards the inner surface 18 of this portion.

The second manipulating assembly 38 continues to move the manifold 42 inwardly until it reaches the transfer position shown in FIG. 6C. The supply of blow-off gas to the lower air tube 96 is then cut off and the lower tubular static bar 110 is de-energized. In the transfer position, the manifold 42 is vertically located slightly above the horizontal platform 134.

The first manipulating assembly 36, or more particularly the elevator 132, then moves the horizontal platform 134 vertically upward to, and past, the manifold loading level. The bottom surface of the manifold 42 almost immediately contacts the assembly 36, or more particularly the bottom portion 22 of the container 12 placed on the horizontal platform 134, and is lifted upward therewith. Because the mounting bracket 148 attached to the manifold 42 is moving upward while the mounting block 146 attached to the load arm 136 remains stationary, the projection pins 150 are released from the openings 152 in the mounting block 146. In this manner, the manifold 42 is no longer mounted to the second manipulating assembly 38 and instead it is transferred to, or loaded on, the first manipulating assembly 36 whereby its motion is controlled by this assembly. (See FIG. 6D)

Once the manifold 42 is loaded on the first manipulating assembly 36, the load arm 136 is retracted. Additionally, blow-off gas is supplied to the upper manifold inlet 92 and the circular static bar 112 is energized. The elevator 132 then moves the horizontal platform 134, and the manifold 42 positioned thereon, to the uppermost position shown in FIG. 6E. This vertical movement is repeated to allow the ionized blow-off gas from the top blow-off nozzles 106 and the air knife 102 to adequately sweep the inner surface 16 of the container top portion 20. In the preferred process, this vertical movement is repeated four times, although this number may be increased or decreased depending on the application and decontamination needs. However, it is necessary for this "sweeping" sequence to end with the horizontal platform 134, and the manifold 42 placed thereon, positioned above the manifold-unloading level.

Once the desired number of vertical movements is completed, the blow-off gas supply to the upper manifold inlet 92 is cut off and the circular static bar 112 is de-energized. The load arm 136 is then moved laterally inward from its rest position to the transfer position so that the manifold 42 may be transferred from the first manipulating assembly 36 to the second manipulating assembly 38. More specifically, the load arm 136 is positioned so that the upwardly projecting pins 150 are located directly below the aligned openings 152 in the mounting block 146.

The elevator 132 then lowers the manifold 42 to and past the manifold-unloading level whereby the projection pins 150 will once again be inserted into the openings 152, and the manifold 42 will be mounted to the second manipulating assembly 38. This positioning of the manifold 42 and load arm 136, or more particularly the projection pins 150 and the openings 152, may be aided by the locator pins 160. In any event, the elevator 132 may continue its downward movement to the manifold-loading position whereby the manifold 42 will be located slightly above the platform 134 and the bottom portion 22 of the container 12 placed thereon.

Blow-off gas is once again supplied to the lower air tube 96 and the lower tubular static bar 110 is again energized. The piston 140 of the air cylinder 142 is retracted whereby the load arm 136, and the manifold 42 are moved back towards the rest position. During this movement, the ionized blow-off gas from the lower air tube 96 is once again directed towards the inner surface 18 of the bottom portion 22 of the container 12. When the load arm 136 reaches the rest position, the blow-off gas supply to the lower air tube 96 and the electric supply to the lower static bar 110 is terminated.

The elevator 132 then raises the horizontal platform 134 to the container-manipulating level whereby the bottom portion 22 may be re-coupled to the top portion 20 of the container 12. More specifically, the coupling interface proceeds to release the previously retracted latches whereby the bottom portion 22 is coupled to the top portion 20. The decontamination cycle now complete, the wafer container 12 may be removed from the container mounting mechanism 130 and may be returned for use in a semiconductor fabrication process.

Another container 12 may then be placed on the support/containment assembly 30, the start button depressed, and another decontamination cycle will begin. The power is preferably left on between cycles whereby the gas within the containment compartment 32 will be continuously circulated and filtered.

To monitor the decontamination device 10 and process, a strategically located laser particle counter (not shown) may be incorporated into the device. Such a counter allows an accurate, on going, evaluation of the effectiveness of the decontamination device 10. Additionally, other operational parameters, such as the number of necessary blow-off gas sweep paths and the frequency of container decontamination, could be determined.

One may now appreciate that the decontamination device 10 of the present invention may be used to provide periodic decontamination for carriers such as the illustrated container 12. While the device 10 would not be directly involved in the a semiconductor fabrication process, it would play an important role in the success of such a process by insuring minimal particulate contamination in the carrier.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A decontamination device for a wafer container having a chamber for storing semiconductor wafers and inner surfaces surrounding said chamber, said container having movable portions manipulatable between a container open condition and a container closed condition, said device comprising:

a support/containment assembly having a substantially sealed containment compartment and a support element which at least initially provides a support for said wafer container;

a manipulating assembly, movably mounted in said support/containment assembly, and provided with a manipulator which manipulates said wafer container between said open condition and said closed condition and which places said chamber, when such wafer container is in said open condition, in a position whereat it forms a portion of said containment compartment and is in flow communicating what said containment compartment; and a gas flow assembly, mounted on said support/containment assembly, which supplies a substantially continuous flow of circulation gas throughout said containment compartment and throughout said container chamber when it is in flow communication with said containment compartment, a manifold within said containment compartment movable with respect to said containment compartment which dispenses blow-off gas provided from said gas flow assembly, said manifold being sized to fit within said chamber of said wafer container;

said manipulating assembly also positions said manifold within said chamber and in close proximity to said inner surfaces whereby said blow-off gas contacts said inner surfaces and whereby particles adhered to said surfaces will be released and entrained by said continuous flow of circulating gas.

2. A decontamination device as set forth in claim 1 wherein said gas flow assembly includes an ionization element which periodically ionizes the gas flows through said containment compartment whereby statically charged containment particles adhered to said inner surfaces of said wafer container will be released and entrained by said flow of circulation gas.

3. A decontamination device as set forth in claim 1 wherein said gas flow assembly further includes:

a blower which induces the circulation gas to circulate through said containment compartment;

a filter, sealably connected to the outlet of said blower, which filters said circulation gas thereby creating a flow of filtered circulation gas;

a circulation gas supply which supplies said filtered circulation gas to said manifold; and a blow-off gas supply which supplies said blow-off gas to said manifold.

4. A decontamination device as set forth in claim 1 wherein said manipulating assembly comprises a first manipulating assembly including:

a container-manipulating mechanism which manipulates said wafer container; and a manifold-manipulating mechanism which positions said manifold within such chamber and in close proximity to said inner surfaces.

5. A decontamination device for a wafer container having a chamber for storing semiconductor wafers and inner surfaces surrounding said chamber, said container having movable portions manipulatable between a container open condition and a container closed condition, said device comprising:

a support/containment assembly having a substantially sealed containment compartment and a support element which at least initially provides a support for said wafer container;

a manipulating assembly, movably mounted in said support/containment assembly, and provided with a manipulator which manipulates such wafer container between said open condition and said closed condition and which places said chamber, when said wafer container is in said open condition, in a position whereat it forms an extension of id containment compartment nd is in communication with said containment compartment; and a gas flow assembly, mounted on said support/containment assembly, which supplies a substantially continuous flow of circulation gas throughout said containment compartment and throughout said container chamber when it is in flow communication with said containment compartment, a manifold within said containment compartment movable with respect to said containment compartment which dispenses said circulation gas and blow off gas provided from said gas flow assembly, said manifold comprising a main body and a bottom extension, said main body being sized to fit within said chamber of said wafer container;

said manipulating assembly also positions said main body portion of said manifold within said chamber and in close proximity to said inner surfaces whereby said blow-off gas contacts said inner surfaces and whereby particles adhered to said surfaces will be released and entrained by said continuous flow of circulation gas; and wherein said gas flow assembly further includes a blower which induces said circulation gas to circulate through said containment compartment, a filter which is sealably connected to the outlet of said blower and which filters said circulation gas thereby creating a flow of filtered circulation gas, a circulation gas supply which supplies said filtered circulation gas to said manifold; and a blow-off gas supply which supplies said blow-off gas to said manifold.

6. A decontamination device for a wafer container having a chamber for storing semiconductor wafers and inner surfaces surrounding said chamber, said container having movable portions manipulatable between a container open condition and a container closed condition, said device comprising:

a support/containment assembly having a substantially sealed containment compartment and a support element which at least initially provides a support for said wafer container;

a manipulating assembly, movable mounted in said support/containment assembly, and provided with a manipulator which manipulates said wager container between said open condition and said closed condition and which places said chamber, when such wafer container is in said open condition, in a position whereat it forms an extension of said containment compartment nd is in flow communication with said containment compartment; and a gas flow assembly, mounted on said support/containment assembly, which supplies a substantially continuous flow of circulation gas throughout said containment compartment and throughout said container chamber when it is in flow communication with said containment compartment, a manifold within said containment compartment movable with respect to said containment compartment which dispenses said circulation gas and glow off gas provided from said gas flow assembly, said manifold comprising a main body and a bottom extension, said main body being sized to fit within said chamber of said wafer container;

said manipulating assembly also position said main body portion of said manifold within said chamber and in close proximity to said inner surfaces whereby said blow-off gas contacts said inner surfaces and whereby particles adhered to said surfaces will be released and entrained by said continuous flow of circulation gas; and wherein said gas flow assembly further includes a blower which induces said circulation gas to circulate through said containment compartment, a filer which is sealably connected to the outlet of said blower and which filers said circulation gas thereby creating a flow of filtered circulation gas, a circulation gas supply which supplies said filtered circulation gas to said manifold; and a blow-off gas supply which supplies said blow-off gas to said manifold; and wherein said manifold further comprises a circulation gas dispenser located on said main body, a top blow-off gas dispenser located on a top portion of said main body, a side blow-off gas dispenser located on said portions of said main body, a bottom blow-off gas dispenser located on said bottom extension a top ionization element located within said main body, and a bottom ionization element located within in said bottom extension.

7. A decontamination device for a wafer container having a chamber for storing semiconductor wafers and inner surfaces surrounding said chamber, said container having movable portions manipulatable between a container open condition and a container closed condition, said device comprising:

a support/containment assembly having a substantially sealed containment compartment and a support element which at least initially provides a support for said wafer container;

a manipulating assembly, movably mounted in said support/containment assembly, which manipulates said wafer container between said open condition and said closed condition and which places said chamber, when said wafer container is in said open condition, in a position whereat it forms an extension of said containment compartment and is in flow communication with said containment compartment; and a gas flow assembly, mounted on said support/containment assembly, which supplies a substantially continuous flow of circulation gas throughout said containment compartment and throughout said container chamber when it is in flow communication with said containment compartment, a manifold within said containment compartment movable with respect to said containment compartment for dispensing blow-off gas provided from said gas flow assembly, said manifold being sized to fit within such chamber of such wafer container;

said manipulating assembly also positions said manifold within said chamber and in close proximity to said inner surfaces whereby said blow-off gas contacts said inner surfaces and whereby particles adhered to said surfaces will be released and entrained by said continuous flow of circulating gas;

wherein said manipulating assembly comprises a first manipulating assembly including a container-manipulating mechanism which manipulates said wafer container, and a manifold-manipulating mechanism which positions said manifold within said chamber and in close proximity to said inner surfaces; and wherein said manipulating assembly further comprises a second manipulating assembly which mounts said manifold on said first manipulating assembly.

8. A decontamination device as set forth in claim 7 wherein said support/containment assembly supports the portions of said wafer container forming such chamber in a substantially stationary manner and wherein said manifold-manipulating mechanism includes an elevator which vertically moves said manifold past said inner surfaces of said chamber.

9. A decontamination device as set forth in claim 8 wherein said second manipulating assembly includes a loading mechanism which moves said manifold from a rest position horizontally offset from said elevator to a transfer position vertically aligned with said elevator.

10. A decontamination device as set forth in claim 9 wherein said loading mechanism includes a cylinder-position unit having a piston and a load arm having a first end and an opposite end, said load arm including a holding device for said manifold at said first end and said load arm being operatively connected to the piston of said cylinder-piston unit at the opposite end whereby when said piston is retracted said manifold is placed in said rest position and when piston is extended said manifold is placed in said transfer position.

11. A decontamination device as set forth in claim 10 wherein said elevator includes a horizontal platform which holds said manifold and wherein said elevator moves said horizontal platform between:

a manifold-loading level whereat said manifold is positioned slightly above, and vertically aligned with, said horizontal platform;

a manifold-unloading level whereat said manifold may be positioned horizontally aligned with said load arm;

an upper blow-off level whereat said manifold may be positioned within such chamber of such container; and a container-manipulating level whereat said first manipulating assembly is positioned to manipulate such container.

12. A decontamination device for a wafer container having a chamber for storing semiconductor wafers and inner surfaces surrounding said chamber, said container having a top portion and a removable bottom portion and being manipulable between a container open condition by removing the bottom portion whereby the portions are detached from each other and a container closed condition whereat said portions are connected to each other, said device comprising:

a support/containment assembly having a substantially sealed containment compartment and a support element which at least initially provides a support for said wafer container;

a manipulating assembly movably mounted in said support/containment assembly and provided with a manipulator for manipulating said wafer container sin such a manner that said top portion is detached from said bottom portion and said chamber is placed in a position whereat it forms an extension of said containment compartment and is in flow communication with said containment compartment; and a gas flow assembly, mounted on said support/containment assembly, for supplying a substantially continuous flow of circulating gas throughout said containment compartment ad throughout said container chamber when it is in flow communication with said containment compartment, a movable manifold within said containment compartment which dispenses blow-off gas provided from said gas flow assembly, said manifold being sized to fit within said chamber of said wafer container;

said manipulating assembly also positions said manifold within said chamber and in close proximity to said inner surfaces whereby said blow-off gas contacts said inner surfaces and whereby particles adhered to said surfaces will be released and entrained by said continuous flow of circulation gas.

13. A method of using the decontamination device set forth in claim 3 to decontaminate a wafer container having a chamber for storing semiconductor wafers and inner surfaces surrounding said chamber, said container being manipulatable between a container open condition and a container closed condition, said method comprising the steps of:

providing a substantial sealed containment compartment;

continuously supplying and filtering a flow of circulation gas throughout the containment compartment;

manipulating the wafer container between said closed condition and said open condition and placing the chamber, when said wafer container is in said open condition, in a position whereat it forms an extension of said sealed containment compartment and is in communication with the sealed containment compartment whereby the circulation gas flows throughout the chamber;

connecting a manifold to a supply of blow-off gas;

inserting the manifold within the chamber of the wafer container; and periodically supplying a flow of blow-off gas and directing the blow-off gas toward the inner surfaces of the wafer container whereby the blow-off gas will contact the inner surfaces and whereby particles adhered to said surfaces will be released and entrained by the continuous flow of circulation gas.

14. A decontamination device for a wafer container having a chamber for storing semiconductor wafers and inner surfaces surrounding such chamber, such container including a top portion and a bottom portion, the container being placed in an open condition when the portions are connected to each other and being placed in a closed condition when id portions are detached from each other, said device comprising:

a support/containment assembly which provided a substantially sealed containment compartment nd which at least initially provides a support for such wafer container;

a manipulating assembly, mounted on said support/containment assembly, which manipulates such wafer container whereby such top portion is detached from such bottom portion and such chamber is placed in communication with said containment compartment; and a gas flow assembly, mounted on said support/containment assembly, which supplies a substantially continuous flow of circulation gas throughout said containment compartment nd throughout such chamber when in communication with said containment compartment and which periodically supplies a flow of blow-off gas;

wherein said manipulating assembly also positions said gas flow assembly within such chamber and in close proximity to such inner surfaces.

* * * * *

UNITED STATES PATENT AND TRADEMARK OFFICE

CERTIFICATE OF CORRECTION

PATENT NO. : 5,238,503

DATED : August 24, 1993

INVENTOR(S) : Phenix, et al.

It is certified that error appears in the above-identified patent and that said Letters Patent is hereby corrected as shown below:

Col. 16, Lines 6-7: Please change "communicating what" to --communication with--

Col. 16, Line 68: Please change "id" to --said--

Col. 17, Line 1: Please change "nd" to --and--

Col. 17, Line 50: Please change "nd" to --and-

Col. 17, Line 60: Please change "glow off" to --blow-off--

Col. 17, Line 65: Please change "position" to --positions--

Col. 18, Line 8: Please change "filer" to --filters--

Col. 18, Line 20: After "extension" please add a--,--

Col. 18, Lines 59: Please change "circulating" to --circulation--

Col. 19, Line 57: Please change "sin" to --in--

Col. 19, Line 65: Please change "circulating" to --circulation--

Col. 19, Line 66: Please change "ad" to --and--

Col. 20, Line 46: Please change "id" to --said--

Col. 20, Line 48: Please change "provided" to --provides--

Col. 20, Line 49: Please change "nd" to --and--

UNITED STATES PATENT AND TRADEMARK OFFICE

CERTIFICATE OF CORRECTION

PATENT NO. : 5,238,503

DATED : August 24, 1993

INVENTOR(S) : Phenix, et al.

It is certified that error appears in the above-identified patent and that said Letters Patent is hereby corrected as shown below:

Col. 20, Line 61: Please change 'nd" to --and--.

Signed and Sealed this

Twenty-sixth Day of April, 1994

*Attest:*

*Attesting Officer*

BRUCE LEHMAN

*Commissioner of Patents and Trademarks*